United States Patent [19]

Thompson et al.

[11] Patent Number: 4,567,848

[45] Date of Patent: Feb. 4, 1986

[54] AGITATOR STRUCTURE FOR BREAKING UP AGGLOMERATED DEVELOPER IN A DEVELOPER SUMP

[75] Inventors: Michael D. Thompson, Rochester; Clifford W. Imes, IV, Williamson, both of N.Y.

[73] Assignee: Xerox Corporation, Stamford, Conn.

[21] Appl. No.: 737,952

[22] Filed: May 28, 1985

[51] Int. Cl.[4] ..... G03G 15/09

[52] U.S. Cl. ..... 118/657; 355/3 DD

[58] Field of Search ..... 118/653; 355/3 DD

*Primary Examiner*—Bernard D. Pianalto

[57] ABSTRACT

A new and improved structure for agitating the developer in the sump of a developer apparatus. To this end one or more magnetic steel shim or blade members are provided in the developer sump adjacent the outlet thereof and in the vicinity of a magnetic developer roll. The shape and location of the shim or blade members in the developer sump are such that a transport magnet (i.e., developer roll) rotatably supported adjacent the outlet of the sump causes vibration of the shim or blades due to the coupling and decoupling therebetween of the magnetic force fields created through the rotation of the developer roll.

9 Claims, 2 Drawing Figures

AGITATOR STRUCTURE FOR BREAKING UP AGGLOMERATED DEVELOPER IN A DEVELOPER SUMP

BACKGROUND OF THE INVENTION

This invention relates to printing machines, and more particularly, to a development apparatus for developing latent electrostatic images on a charge-retentive surface and, more particularly, to an improved developer sump or storage area for dispensing single component magnetic developer for presentation to a magnetic developer roll which in turn presents the developer to a charge-retentive surface such as photoconductor.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as developer or toner which forms the visible images is transferred to plain paper.

It should be understood that for the purposes of the present invention, which relates to the development of latent electrostatic images with developer particles, the latent electrostatic image may be formed by means other than by the exposure of an electrostatically charged photosensitive member to a light image of an original document. For example, the latent electrostatic image may be generated from information electronically stored or generated in digital form which may afterwards be converted to alphanumeric images by image generation electronics and optics. However, such image generation electronic and optic devices form no part of the present invention.

Many acceptable techniques exit for applying developer, however, one general approach, which is often used commercially, is to attract particulate developer to an applicator surface from the outlet of a developer sump or housing and move the applicator into a transfer relation with the imaging member so that the particles can adhere to the member in accordance with the image pattern. Most commonly, the applicator is a roller which rotates so that its peripheral surface moves between the sump outlet and a zone in transfer relation with the imaging member. Adherence of the developer to such applicator rollers can be accomplished in various ways including, e.g., adhesive or electrical attraction, but the most prevalent commercial technique utilizes magnetic attraction and applicators using the technique are often called magnetic brushes.

Developers used with such magnetic brushes can be single component (in which case toner is magnetically attractable) or comprise two components (in which case the toner particles are electrostatically attracted to magnetically attractable carrier particles in the developer mixture). The magnetic brush applicators can take various forms, however, a typical configuration comprises a non-magnetic outer cylinder which surrounds an array of magnets located within its inner periphery. Developer movement is effected by rotation of the outer cylinder and/or the interior magnet array.

In using such magnetic brushes (and in other applicators such as mentioned above), the uniformity of image-development often depends significantly upon control of the quantity and densitiy (i.e., compactness) and uniformity of developer adhering to the applicator surface. Developer shortage can cause incomplete development and developer excess can cause scratching and other non-uniformities in the developed image. Developer shortage as well as excess can result from developer agglomeration of the developer in the sump.

Although single component developers offer many advantages over two component systems many of these developers have a problem in that they tend to lump up or agglomerate in the developer sump to a greater degree than do two component developers.

The traditional technique for preventing developer agglomeration in the sump has been accomplished by augers or thumping devices the former being mounted in the developer sump and the latter being mounted outside of the sump in contact with the outer surface of one or more walls of the sump. Each of these types of devices usually requires a separate motor and/or drive mechanism for imparting the appropriate motion for effecting break-up of agglomerated developer.

A method and apparatus for applying toner to a charge-retentive surface which purports to solve the problems of developer agglomeration in the sump is disclosed and claimed in U.S. Pat. No. 4,227,796 issued in the name of Kamp et al and assigned to the Eastman Kodak Company. As disclosed therein, a coil spring is provided through which developer from a sump flows. The spring tension is adjustable to vary the flow rate therethrough and is mounted for rotation in order to break up an agglomerated developer as it passes through the spring.

The spring is mounted in intimate contact with the developer roll with which it is associated. It appears that the rotating coil spring acts like a an auger of the type conventionally used in xerographic development and cleaning systems. Thus, the coils of the spring move through the developer while transporting it in the direction of the longitudinal axis of the developer roll to thereby uniformly distribute it on the surface of the the developer roll beyond the line of contact between the spring and the developer roll.

Structure similar to applicants' invention is incorporated in the Model M10 copier machine sold by Ricoh Company, a Japanese Corporation. This machine was first introduced as a commercial product during the summer of 1984 which was subsequent to our invention and less than one year prior to the filing of a patent application on our invention. The developer apparatus of the Ricoh M10 machine utilizes a Mylar (Trademark of E. I. du Pont de Nemours & Co.) flap for breaking up the agglomerated developer in the developer sump. The flap has a strip of magnetic material attached to the free end thereof which is magnetically coupled to the magnetic developer roll and vibrated thereby.

U.S. Pat. No. 4,188,907 discloses and claims a particle dispenser with a magnetically driven agitator immersed in developer particles. An oscillatory magnetic field created through the rotation of a roll magnet causes the agitator to vibrate to thereby preclude bridging and caking of the particles to improve the flow of the developer from the open end of a chamber.

SUMMARY OF THE INVENTION

In order to preclude agglomerated toner from leaving the sump, we have provided a new and improved structure for agitating the developer in the sump. To this end there is disclosed hereinafter in greater detail one or more magnetic steel shim or blade members. The shape and location of the shim or blade members in the developer sump are such that a transport magnet (i.e., developer roll) rotatably supported adjacent the outlet of the sump causes vibration of the shims or blades due to the coupling and decoupling therebetween of the magnetic force fields created through the rotation of the magnetic developer roll.

One important feature of our invention resides in the dimension of the shim or blade member. Therefore, the thickness (i.e., 0.03 inch) thereof is quite small relative to the width and length thereof, the latter being substantially coextensive with the length of the developer roll.

The presence of the shim or blade in the magnetic field created by the rotation of the developer roll enhances the magnet forces of the magnetic field which assists the action of the shims or blades to break up developer agglomerates prior to leaving the sump.

DETAILED DESCRIPTION OF THE DRAWINGS

Figure 1:
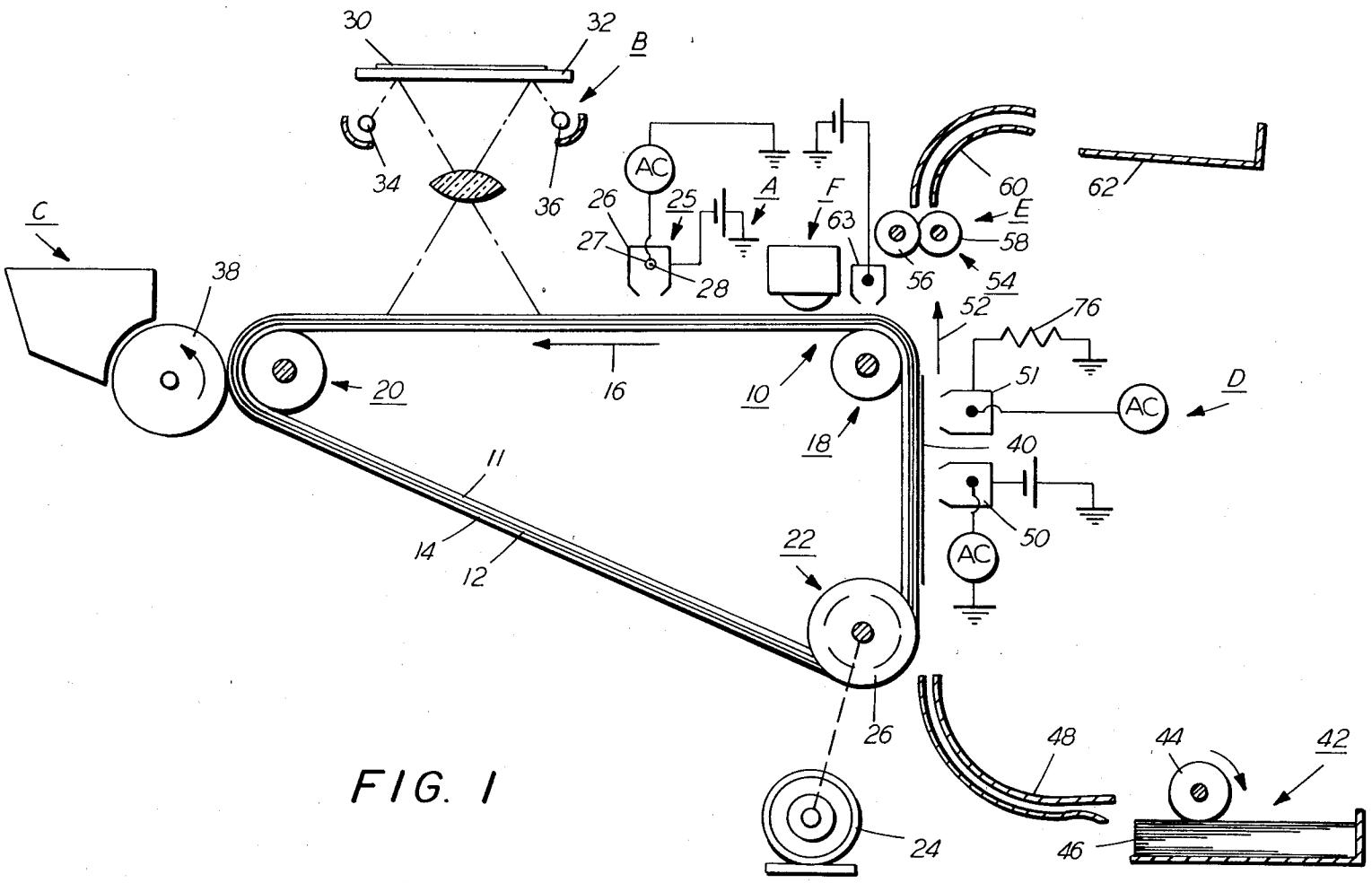
Figure 2:
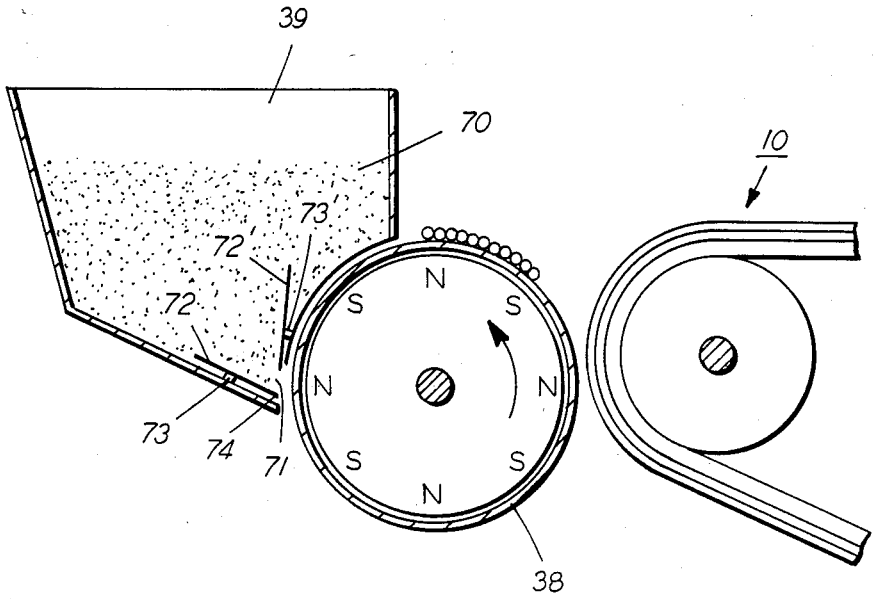

Other aspects of the present invention will become apparent as the following description proceeds with reference to the drawings wherein:

FIG. 1 is a schematic elevational view depicting an electrophotographic printing machine incorporating the present invention; and FIG. 2 is an enlarged schematic view of the developer apparatus of the present invention.

DETAILED DESCRIPTION OF THE INVENTION

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoconductive belt of the foregoing type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain. Belt 10 is maintained in tension by a pair of springs (not shown) which resiliently urge tension roller 20 against belt 20 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by reference numeral 25 charges the layer 12 of belt 10 to a relatively high, substantially uniform negative potential.

A suitable corona generating device for negatively charging the photoconductive belt 10 comprises a conductive shield 26 and corona wire 27, the latter of which is coated an electrically insulating layer 28 having a thickness which precludes a net dc corona current when an A.C. voltage is applied to the corona wire when the shield and photoconductive surface are at the same potential.

Next, the charged portion of the photoconductive belt is advanced through exposure station B. At exposure station B, an original document 30 is positioned face down upon a transparent platen 32. The light rays reflected from original document 30 form images which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 disposed in a developer housing or sump 39 advances developer into contact with the electrostatic latent image. The latent image attracts the developer particles from the developer roller or roll thereby forming visible images on the photoconductive belt. The developer roll 38 may comprise any conventional construction known in the art of printing.

Belt 10 then advances the toner powder image to transfer station D. At transfer station D, a sheet of support material 40 is moved into contact with the toner powder images. The sheet of support material is advanced to transfer station D by a sheet forming apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner power images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder images are permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges to thereby narrow the charge distribution thereon so that a negatively biased cleaning roller or brush 64, to be discussed hereinafter, will be more effective in removing them.

At the cleaning station F, residual toner and contaminants or debris such as paper fibers and Kaolin are removed from the photoreceptor surface by means of brush 64 which is preferably a captive magnetic brush structure which is negatively biased by means of a power source (not shown) and which is rotated in the direction of the arrow 66 via a motor (not shown). In a xerographic or similar type system of the type herein disclosed, the brush 64 will remove the residual toner from the photoreceptor.

As viewed in FIG. 2, the developer sump or housing 39 contains a quantity of single component developer 70. The developer roll 38 is rotatably supported adjacent an opening 71 in the sump such that it picks up developer particles to be presented to the photoconductive belt 10.

Blade members 72 and 72' are secured to the sump by means of non-magnetic supports 73, 73' such that they are suspended in cantilever fashion so that ends, 74, 74' thereof are adjacent the outlet of the sump and are disposed on opposite sides thereof. The blade members are fabricated from a soft magnetic material so that the magnetic forces created by the magnetic field emanating from the magnetic developer roll can cause vibration thereof. Such vibration serves to break up agglomerations in the developer particles in the sump prior the developer being dispensed through the outlet 71.

The blade members 72, 72' preferably have a thickness of 0.030 inch (0.075 mm) and a width that is substantially coextensive with the length of the developer roll 38 and the width of the developer sump. The length (i.e., the distance measured from the free ends 74, 74' to the opposite end thereof) is sufficient to permit vibration vigorous enough to break up the developer agglomerations in the sump region just before the developer material is put onto the development roll.

We claim:

1. Printing apparatus for forming toner images on a charge-retentive surface which surface is moved past processing stations of the printing apparatus, said processing stations including a developer station where latent electrostatic images are rendered visible by the application of single component magnetic developer particles, said apparatus comprising:

developer apparatus positioned at said developer station and comprising a sump for containing a quantity of said single component magnetic developer, said sump including an outlet for dispensing developer;

a magnetic developer roll rotatably supported adjacent said outlet and said charge-retentive surface whereby developer can be carried by said developer roll from said sump to said charge-retentive surface; and at least one blade member supported internally of said sump adjacent said outlet, said blade being fabricated from a soft magnetic material, said at least one blade member being supported close enough to said magnetic developer roll so that it is vibrated due to the influence of the forces created by the magnetic fields created by the rotation of said magnetic developer roll whereby agglomerated developer is broken up prior to its being dispensed to said developer roll.

2. Apparatus according to claim 1 wherein said blade member is attached to said sump via a non-magnetic material.

3. Apparatus according to claim 2 wherein said blade member is supported in cantilever fashion.

4. Apparatus according to claim 1 wherein said blade member is approximately 0.030 inch thick.

5. Apparatus according to claim 4 wherein said blade member is approximately 0.030 inch thick.

6. Apparatus according to claim 1 including another blade member supported internally of said sump adjacent said outlet and positioned relative to said at least one blade member such that the developer in said sump passes therebetween on its way to said outlet.

7. Apparatus according to claim 6 wherein said blade members are attached to said sump via a non-magnetic material.

8. Apparatus according to claim 7 wherein said blade members are supported in cantilever fashion.

9. Apparatus accordingly to claim 8 wherein said blade members are approximately 0.030 inch thick.

* * * * *